US007658457B2

(12) United States Patent
Lu

(10) Patent No.: US 7,658,457 B2
(45) Date of Patent: Feb. 9, 2010

(54) INNER SLIDING RAIL MOUNTING STRUCTURE FOR SLIDING TRACK ASSEMBLY FOR DRAWER

(75) Inventor: Chun-Min Lu, Taipei Hsien (TW)

(73) Assignee: Gslide Corporation, Taipei Hsien (TW)

( * ) Notice: Subject to any disclaimer, the term of this patent is extended or adjusted under 35 U.S.C. 154(b) by 0 days.

(21) Appl. No.: 11/508,269

(22) Filed: Aug. 23, 2006

(65) Prior Publication Data

US 2007/0108880 A1 May 17, 2007

(30) Foreign Application Priority Data

Nov. 16, 2005 (TW) ..... 94219830 U

(51) Int. Cl.
*A47B 88/00* (2006.01)

(52) U.S. Cl. ..... 312/334.47; 312/333

(58) Field of Classification Search ..... 312/334.47, 312/333, 334.1, 334.44, 334.46, 319.1, 334.8, 312/334.7; 384/21

See application file for complete search history.

(56) References Cited

U.S. PATENT DOCUMENTS 3,141,714 A * 7/1964 Valitus ..... 312/334.46
5,169,238 A * 12/1992 Schenk ..... 384/21
6,375,290 B1 * 4/2002 Lin et al. ..... 312/334.46
6,585,337 B1 * 7/2003 Chen et al. ..... 312/334.46
6,817,685 B2 * 11/2004 Lammens ..... 312/334.47
6,945,619 B1 * 9/2005 Chen et al. ..... 312/334.47
7,101,081 B2 * 9/2006 Chen et al. ..... 384/21
7,374,261 B1 * 5/2008 Wang ..... 312/333
7,404,611 B1 * 7/2008 Que ..... 312/334.46
2002/0021061 A1 * 2/2002 Lammens ..... 312/334.44
2004/0239221 A1 * 12/2004 Yang ..... 312/334.46
2005/0248247 A1 * 11/2005 Huang ..... 312/334.47
2008/0079342 A1 * 4/2008 Peng et al. ..... 312/333

* cited by examiner

*Primary Examiner*—Janet M Wilkens
(74) *Attorney, Agent, or Firm*—Troxell Law Office, PLLC

(57) ABSTRACT

A inner sliding rail mounting structure is disclosed to include a control plate pivoted with a front side thereof to an inner sliding rail of a sliding track assembly for engagement with a stop block of an intermediate sliding rail of the sliding track assembly to secure the inner sliding rail to the intermediate sliding rail, a slide pivoted to the rear side of the control plate and coupled to the inner sliding rail by a slip joint for biasing the control plate to disengage the control plate from the stop block of the intermediate sliding rail for allowing removal of the inner sliding rail from the intermediately sliding rail, and a carriage affixed to the rear side of the slide and holding a spring member against a locating block at the inner sliding rail for pulling by the user to force the slide to bias the control plate.

1 Claim, 13 Drawing Sheets

INNER SLIDING RAIL MOUNTING STRUCTURE FOR SLIDING TRACK ASSEMBLY FOR DRAWER

BACKGROUND AND SUMMARY OF THE INVENTION

The present invention relates to sliding track assembly for drawer or the like and more specifically, to am inner sliding rail mounting structure for sliding track assembly, which saves much manufacturing cost and much installation labor and time and, which is quickly detachable with either the left hand or the right hand.

FIGS. 1~3 show a conventional sliding track assembly 7, which is comprised of an inner sliding rail 71, an intermediate sliding rail 72, and an outer sliding rail 73. The intermediate sliding rail 72 has a stop block 721 for engagement with a retaining side notch 80 on a locking bar 8, which has one end pivoted to the inner sliding rail 71 and is supported on a torsional spring 82 inside the inner sliding rail 71. When wishing to disconnect the inner sliding rail 71 from the intermediate sliding rail 72, bias the free end 81 of the locking bar 8 against the torsional spring 82 to disengage the retaining side notch 80 from the stop block 721 of the intermediate sliding rail 72. This design of sliding track assembly has drawbacks as follows:

1. The two opposite lateral sidewalls of the drawer are respectively affixed to the inner sliding rails 71 of the associating sliding track assemblies (see FIGS. 2 and 3). When wishing to detach the inner sliding rails 71 from the associating intermediate sliding rails 72, the user must extend out the both hands in horizontal and approach the both hands to the two opposite lateral sidewalls of the drawer and then use the fingers of the both hands to turn the free ends 81 of the respective locking bars 8 upwards or downwards. It is inconvenient to turn the locking bars 8 with the fingers of the two hands in reversed directions.

2. When detaching the drawer, the user must turn the locking bars 8 of two sliding track assemblies at two sides of the drawers in reversed directions so that the locking bars 8 can be respectively disengaged from the stop blocks 721 of the associating intermediate sliding rails 72. If the user turns each locking bar 8 in the wrong direction with force, the respective locking bar 8 may be damaged.

FIGS. 4 and 5 show another structure of sliding track assembly according to the prior art. According to this design, the sliding track assembly is comprised of an inner sliding rail 92, an intermediate sliding rail 91, and an outer sliding rail 93. The intermediate sliding rail 91 has a stop block 911. The inner sliding rail 92 has mounted thereon a first locating member 921, a second locating member 922, a spring member, a third locating member 923, a release control bar 925, and a link 926. By means of operating the release control bar 925 or the link 926 to move the first locating member 921, the second locating member 922 and the third locating member 924, the stop block 911 of the inner sliding rail 92 is disengaged from the intermediate sliding rail 91. This design of sliding track assembly is functional, however it has a complicated structure, resulting in a high manufacturing cost and complicated installation procedure.

The present invention has been accomplished under the circumstances in view. It is therefore one object of the present invention to provide an inner sliding rail mounting structure for sliding track assembly, which has a simple structure and is easy to install. It is another object of the present invention to provide an inner sliding rail mounting structure for sliding track assembly, which is suitable for mass production, saving much the manufacturing cost. It is still another object of the present invention to provide an inner sliding rail mounting structure for sliding track assembly, which is easy to operate and fits the right hand as well as the left hand.

To achieve these and other objects of the present invention, the inner sliding rail mounting structure comprises a control plate pivoted with a front side thereof to an inner sliding rail of a sliding track assembly for engagement with a stop block of an intermediate sliding rail of the sliding track assembly to secure the inner sliding rail to the intermediate sliding rail, a slide pivoted to the rear side of the control plate and coupled to the inner sliding rail by a slip joint for biasing the control plate to disengage the control plate from the stop block of the intermediate sliding rail for allowing removal of the inner sliding rail from the intermediately sliding rail, and a carriage affixed to the rear side of the slide and holding a spring member against a locating block at the inner sliding rail for pulling by the user to force the slide to bias the control plate.

DETAILED DESCRIPTION OF THE INVENTION

Figure 1:
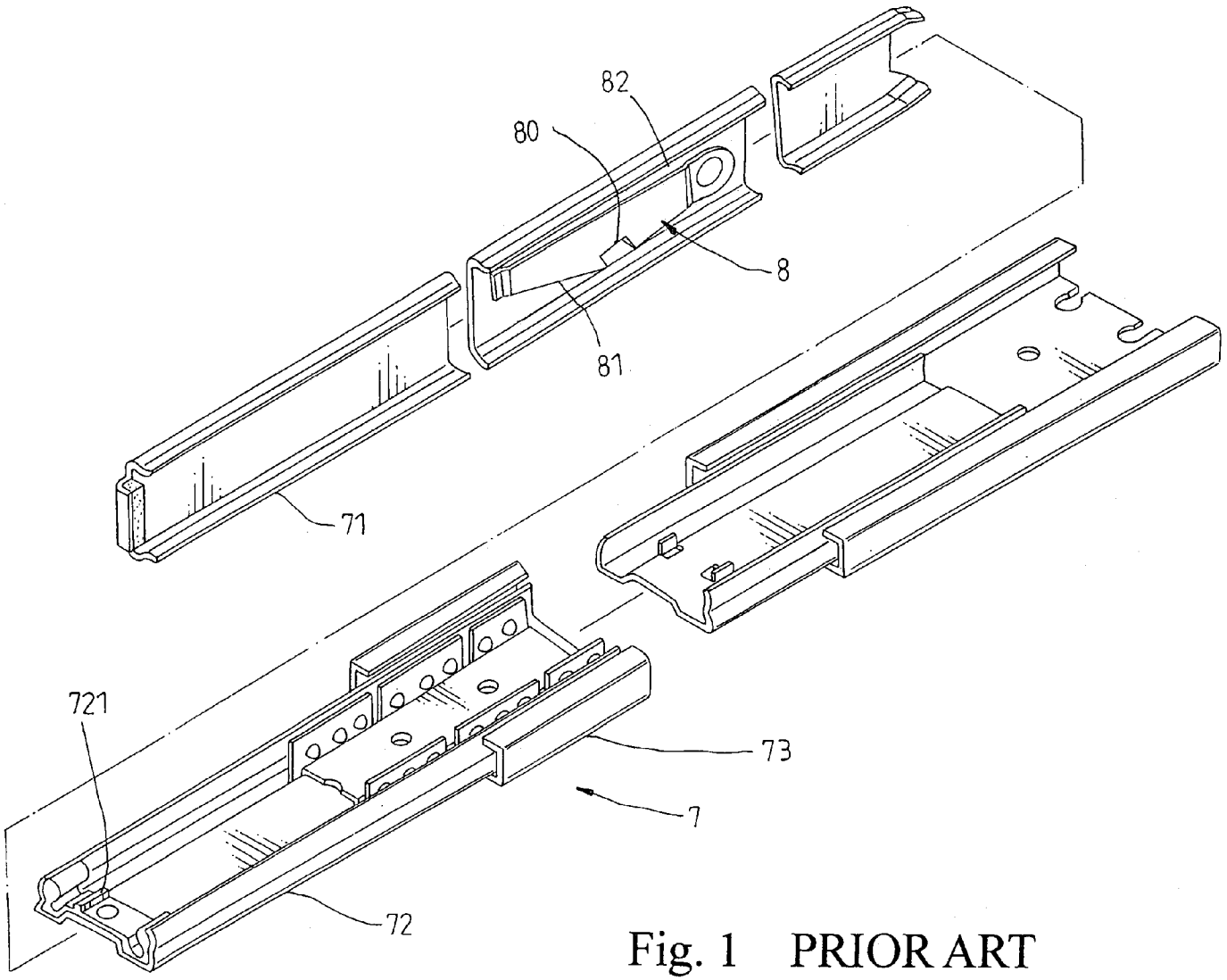
Fig. 1 PRIOR ART
FIG. 1 is an exploded view of a sliding track assembly for drawer according to the prior art.
Figure 2:
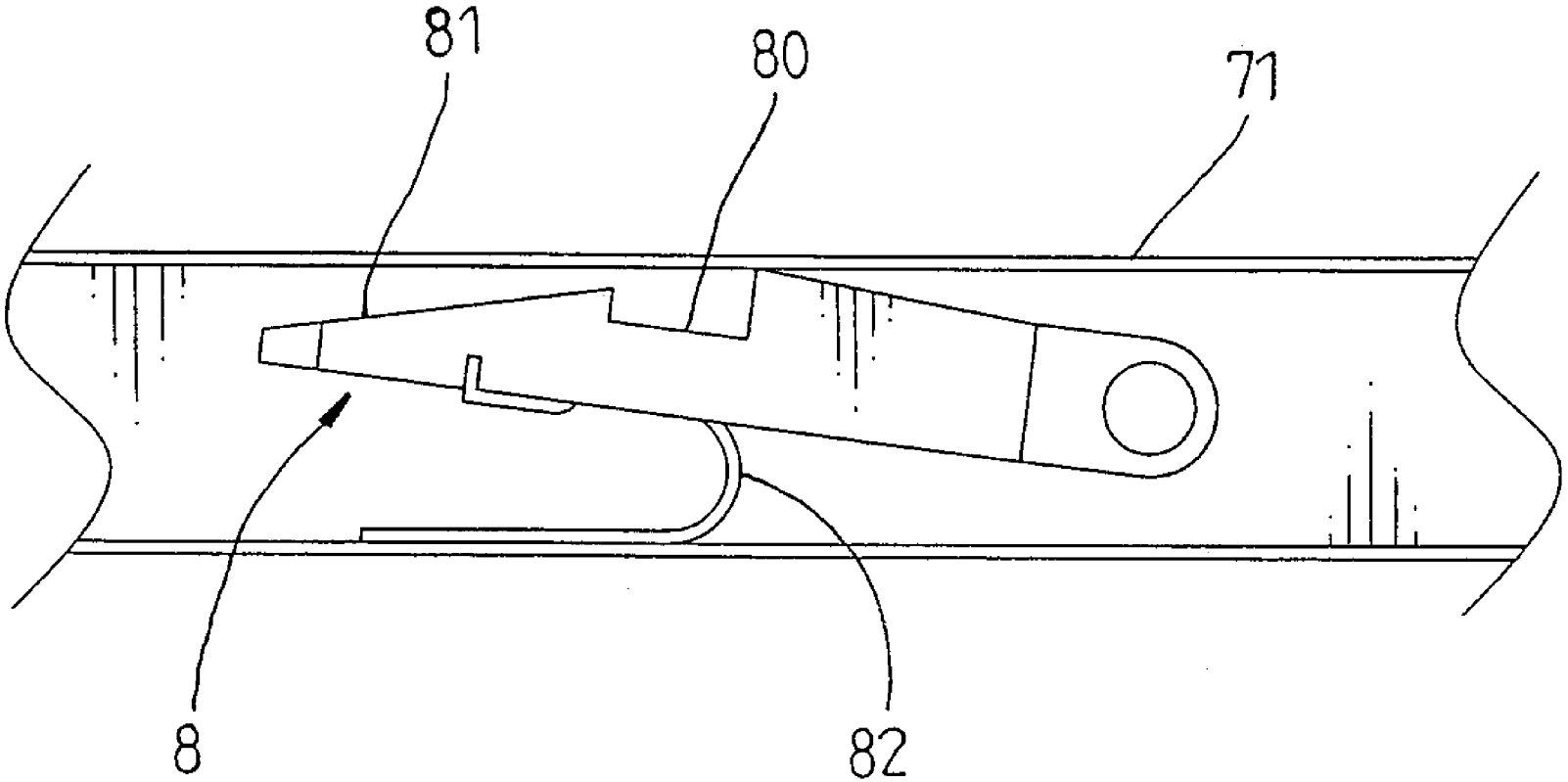
Fig. 2 PRIOR ART
FIG. 2 is a plain view of a part of the inner sliding rail for the sliding track assembly shown in FIG. 1.
Figure 3:
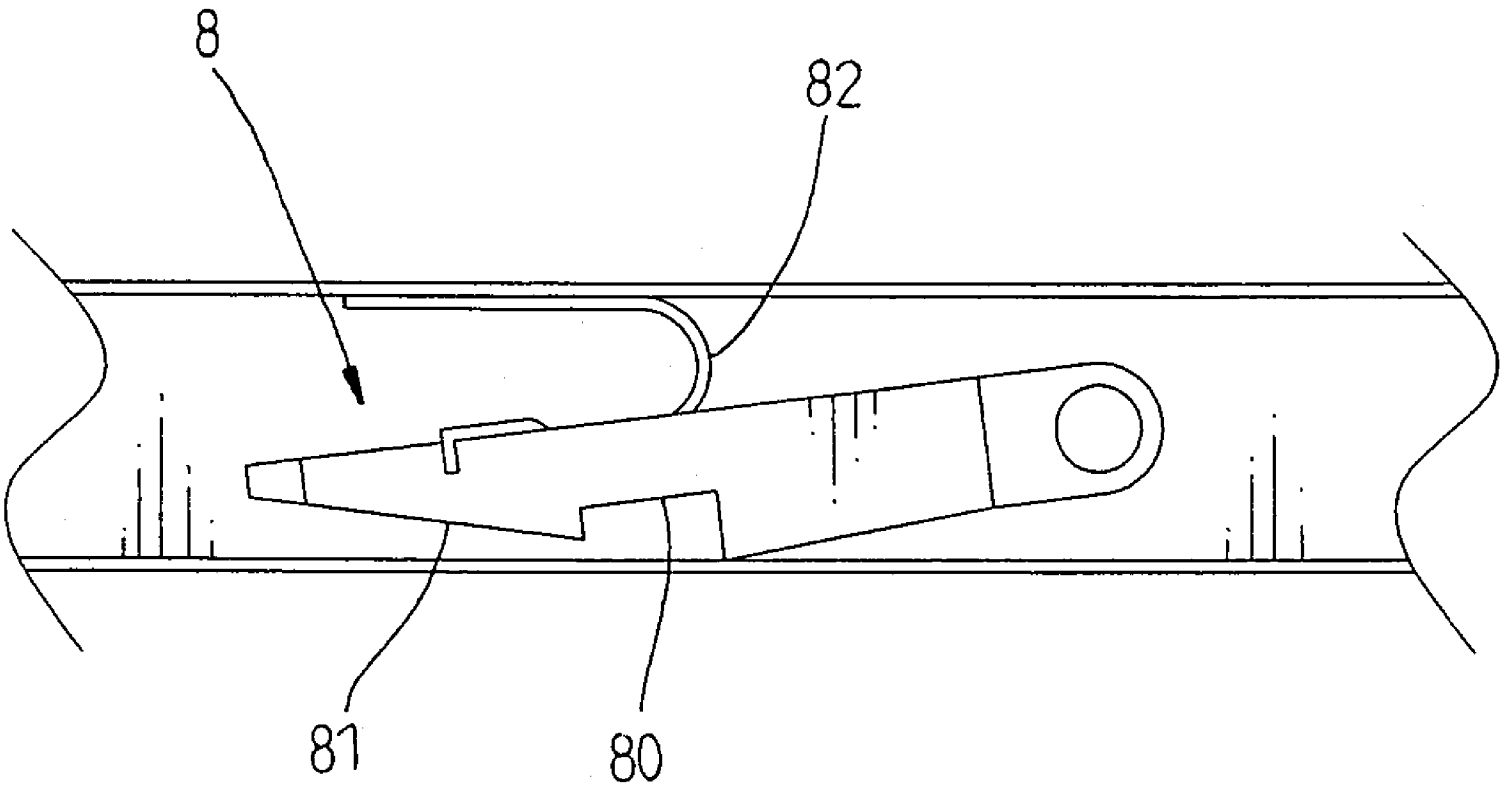
Fig. 3 PRIOR ART
FIG. 3 corresponds to FIG. 2, showing the release control bar and the torsional spring installed in the inner sliding rail in a reversed direction.
Figure 4:
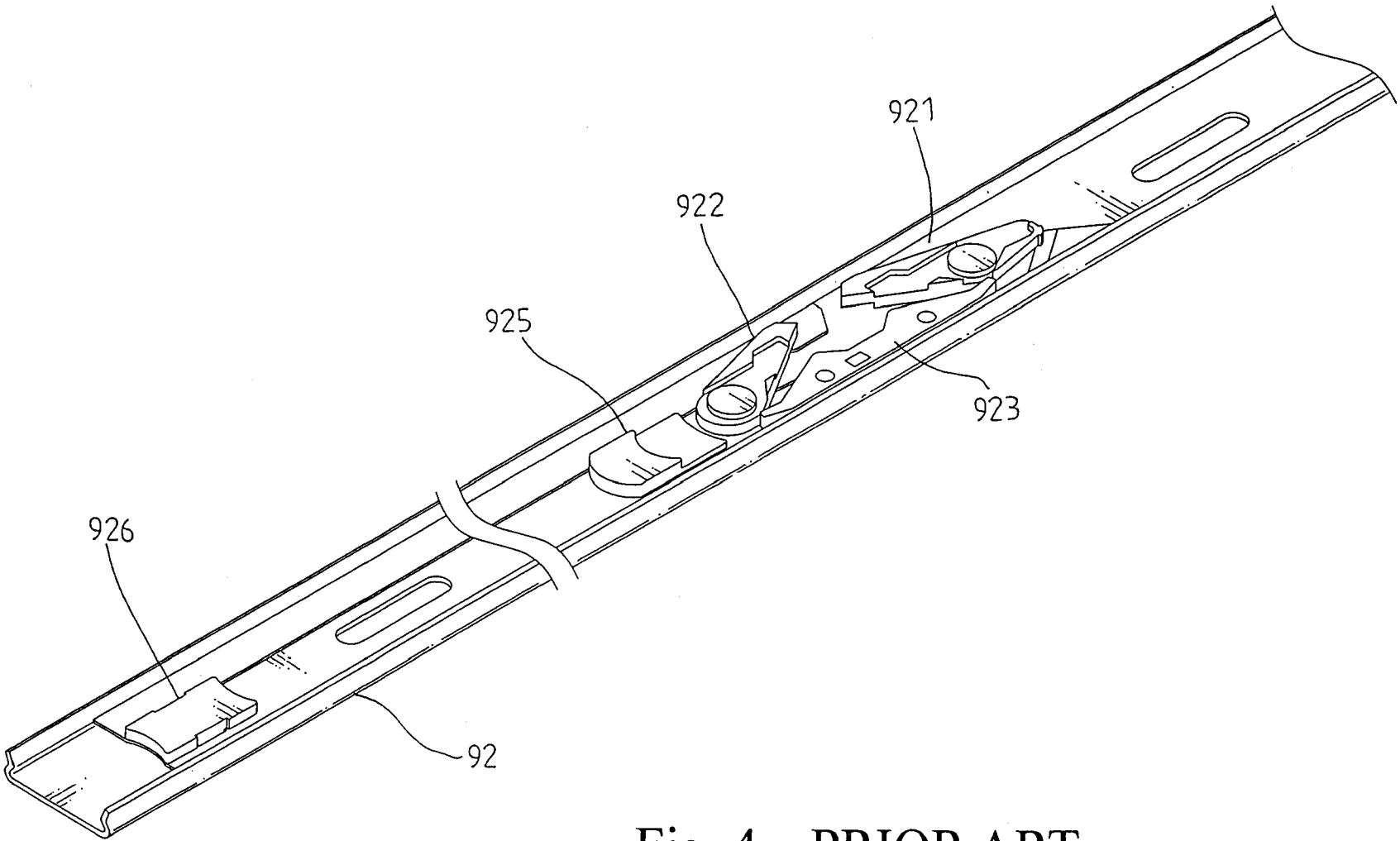
Fig. 4 PRIOR ART
FIG. 4 is an elevational view of an inner sliding rail of another structure of sliding track assembly for drawer according to the prior art.
Figure 5:
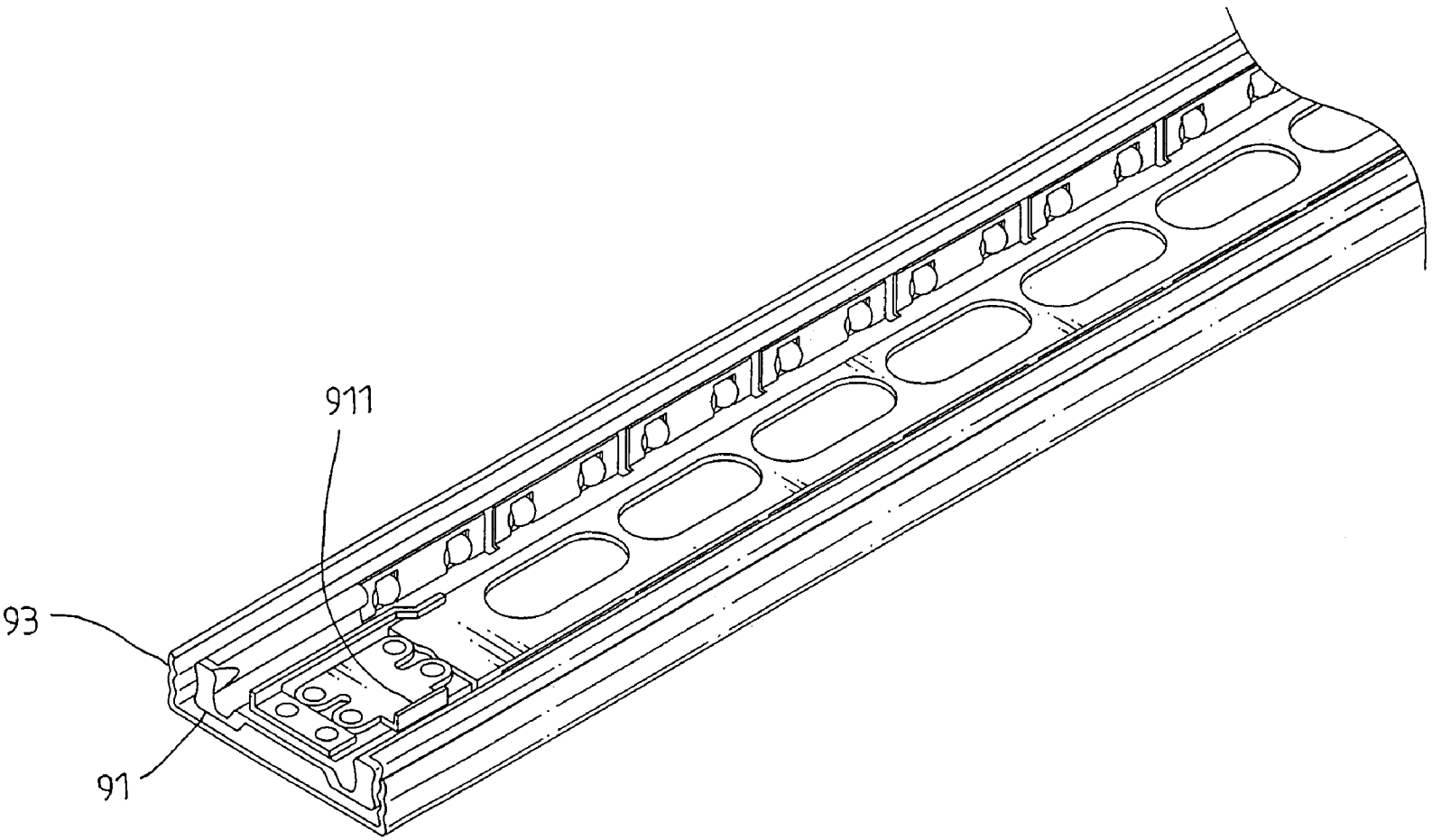
Fig. 5 PRIOR ART
FIG. 5 is an elevational assembly view of intermediate sliding rail and outer sliding rail of the sliding track assembly for use with the inner sliding rail shown in FIG. 4.
Figure 6:
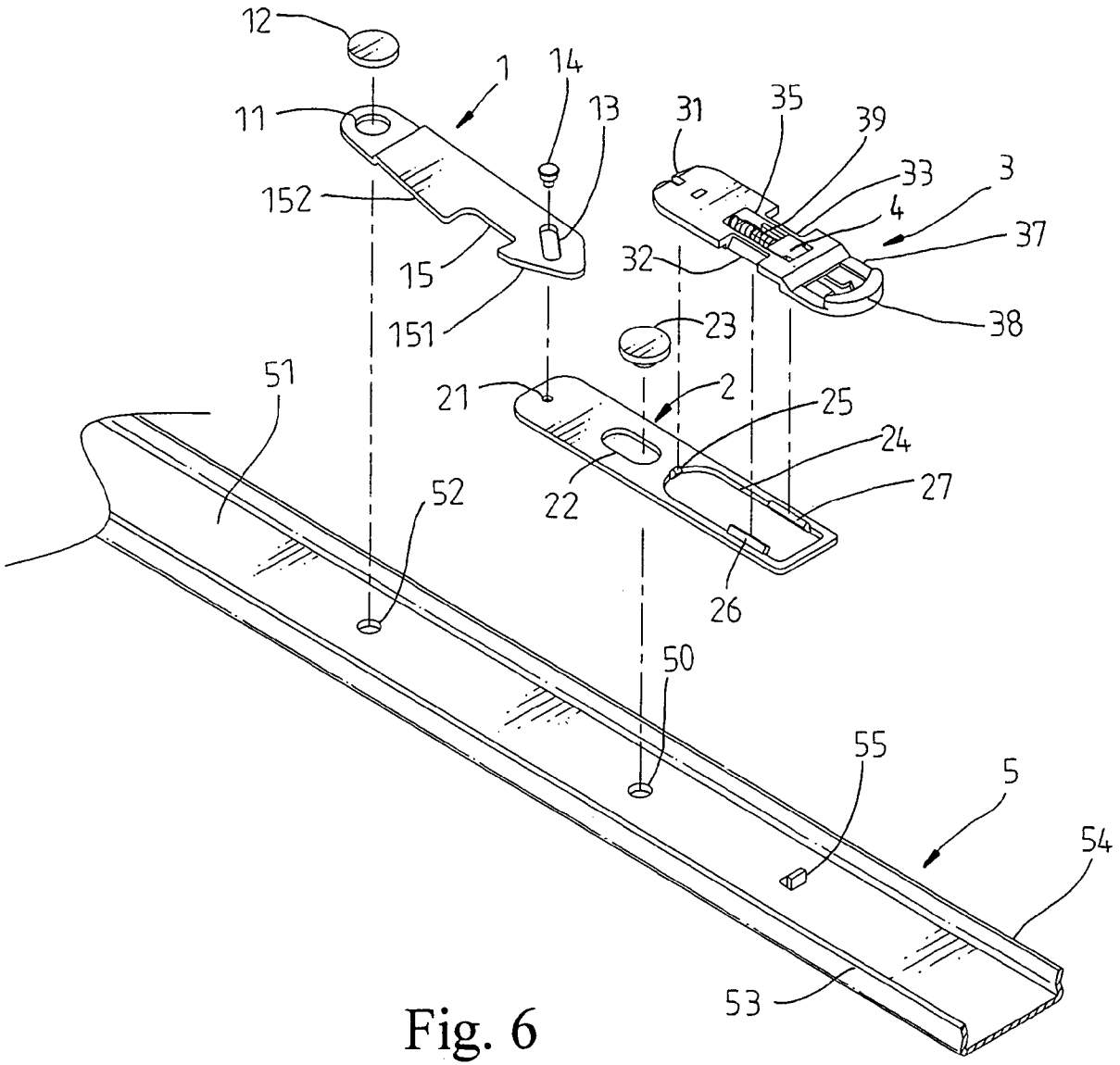
FIG. 6 is an exploded view of an inner sliding rail mounting structure according to the present invention.
Figure 7:
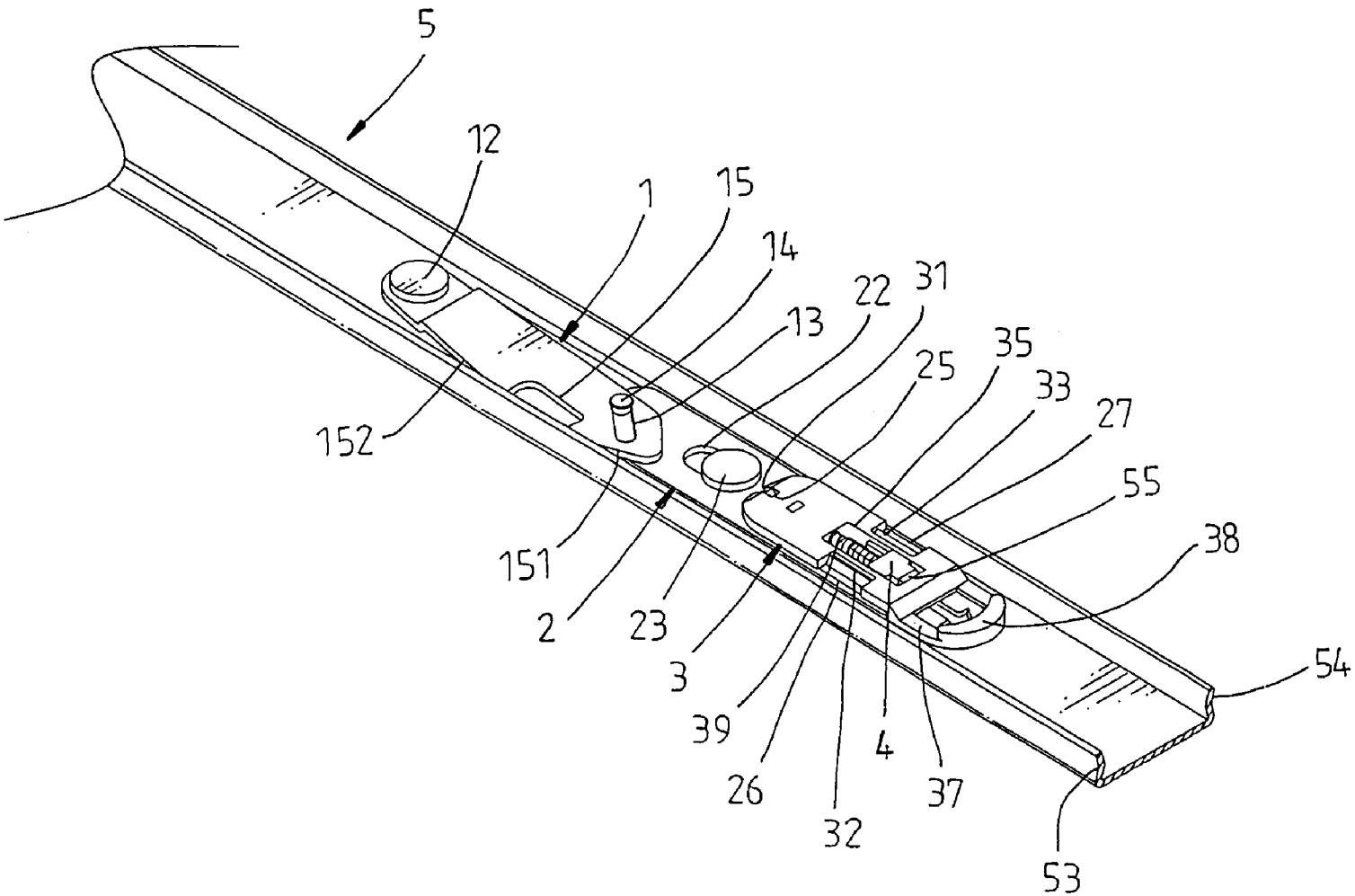
FIG. 7 is an elevational assembly view of the inner sliding rail mounting structure shown in FIG. 6.
Figure 8:
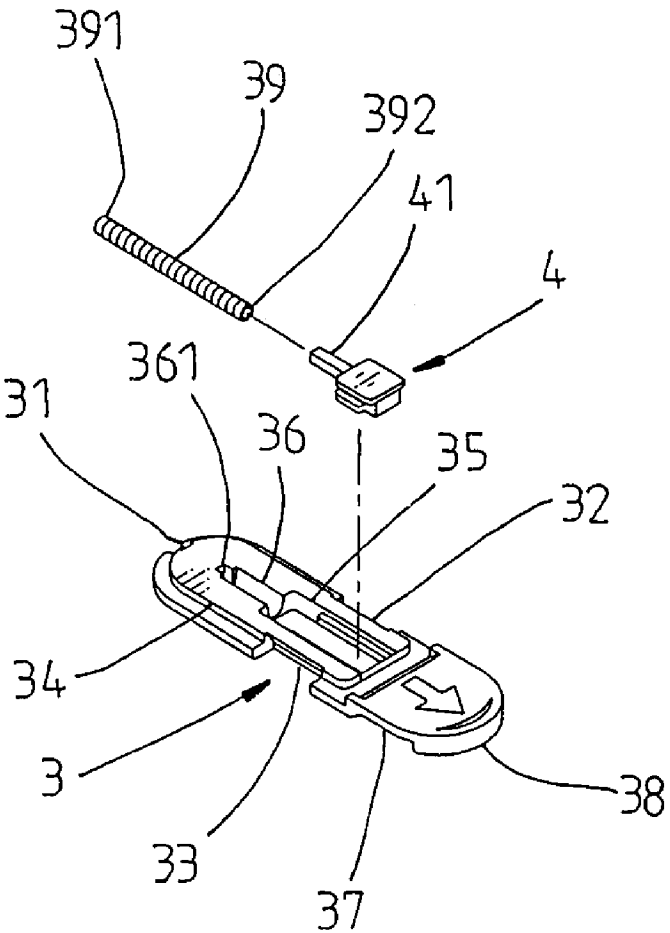
FIG. 8 is an exploded view of a part of the inner sliding rail mounting structure according to the present invention, showing the relationship between the spring member and guide block and the carriage.
Figure 9:
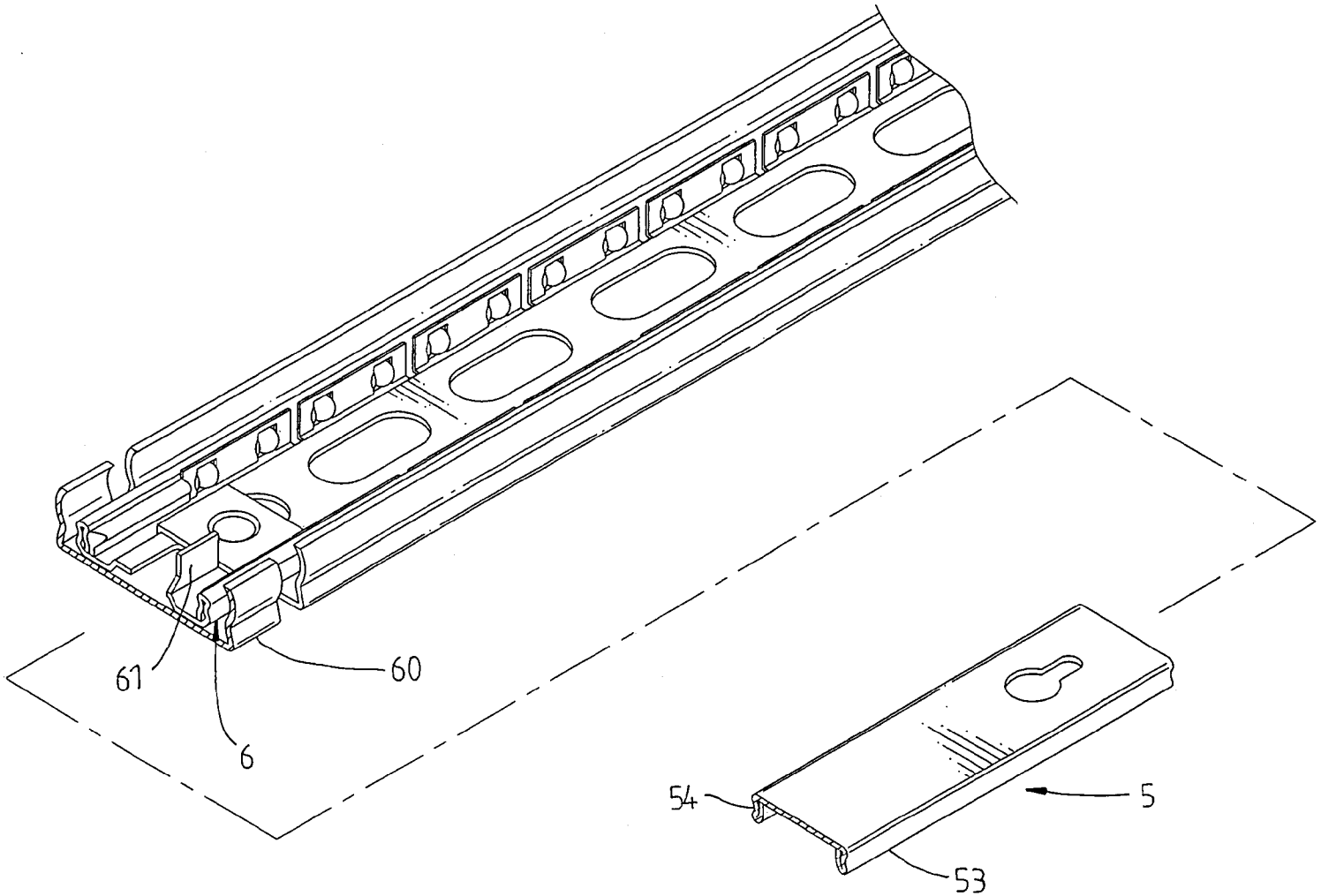
FIG. 9 is an exploded view of a sliding track assembly using the inner sliding rail mounting structure according to the present invention.
Figure 10:
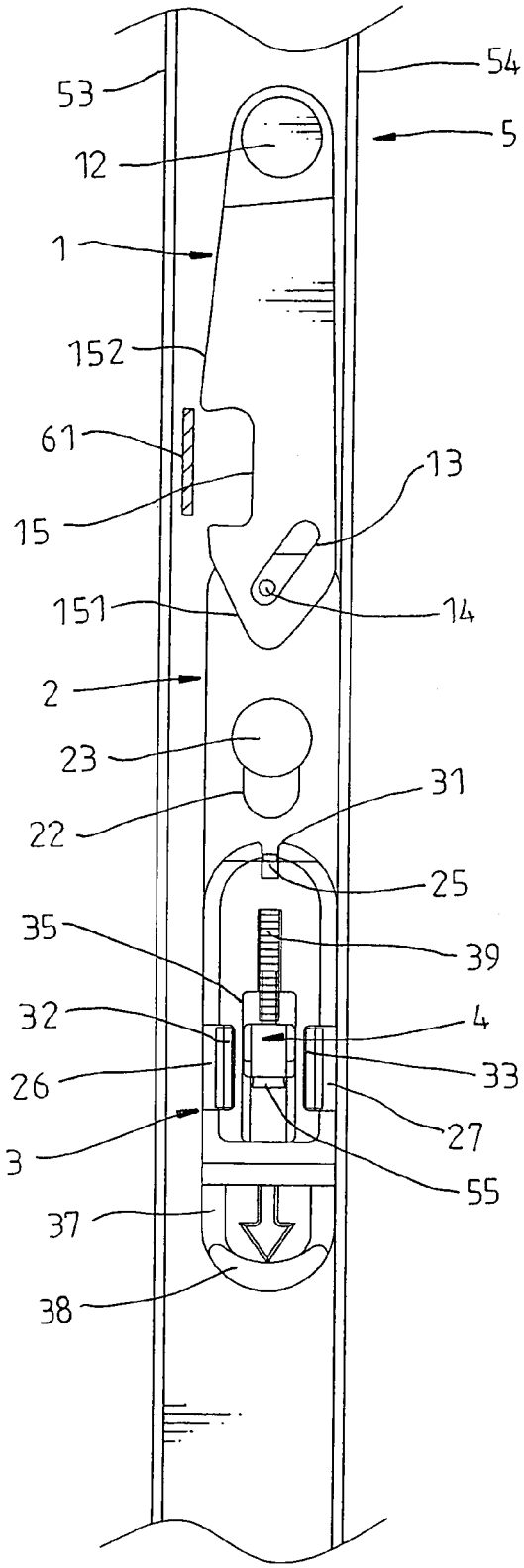
FIG. 10 is a schematic plain view showing the inner sliding rail inserted into the intermediate sliding rail and the retaining side notch of the control plate aimed at the stop block of the intermediate sliding rail.
Figure 11:
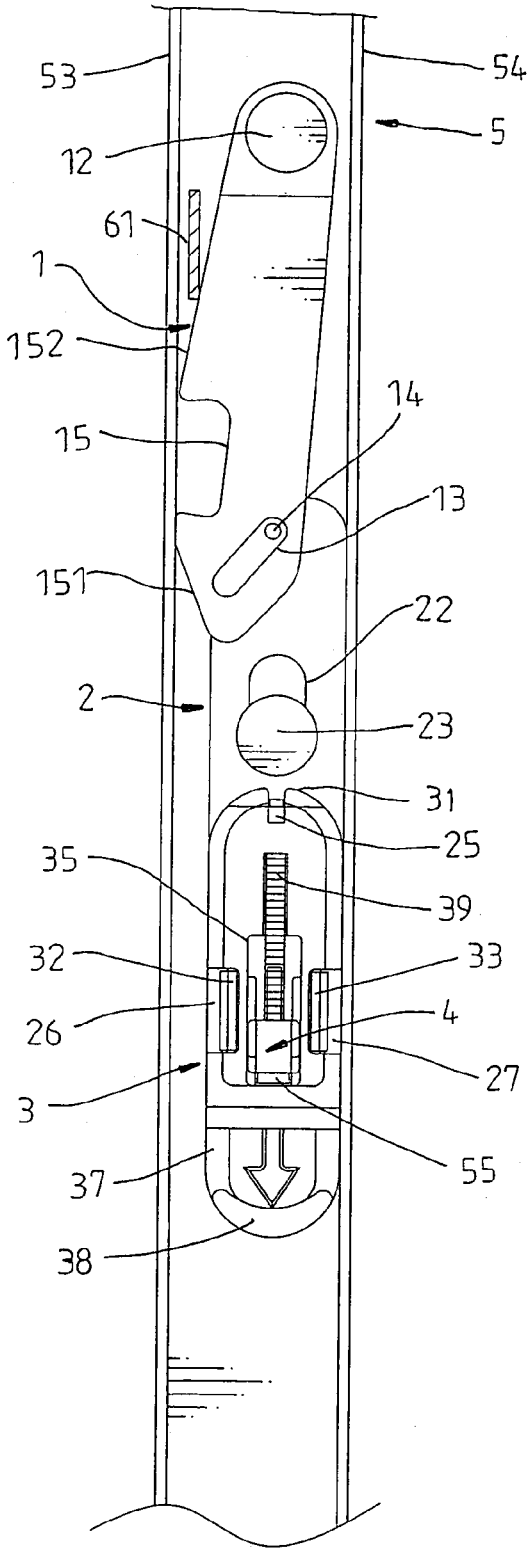
FIG. 11 is a schematic plain view of the present invention, showing the stop edge of the control plate in contact with the stop block of the intermediate sliding rail.
Figure 12:
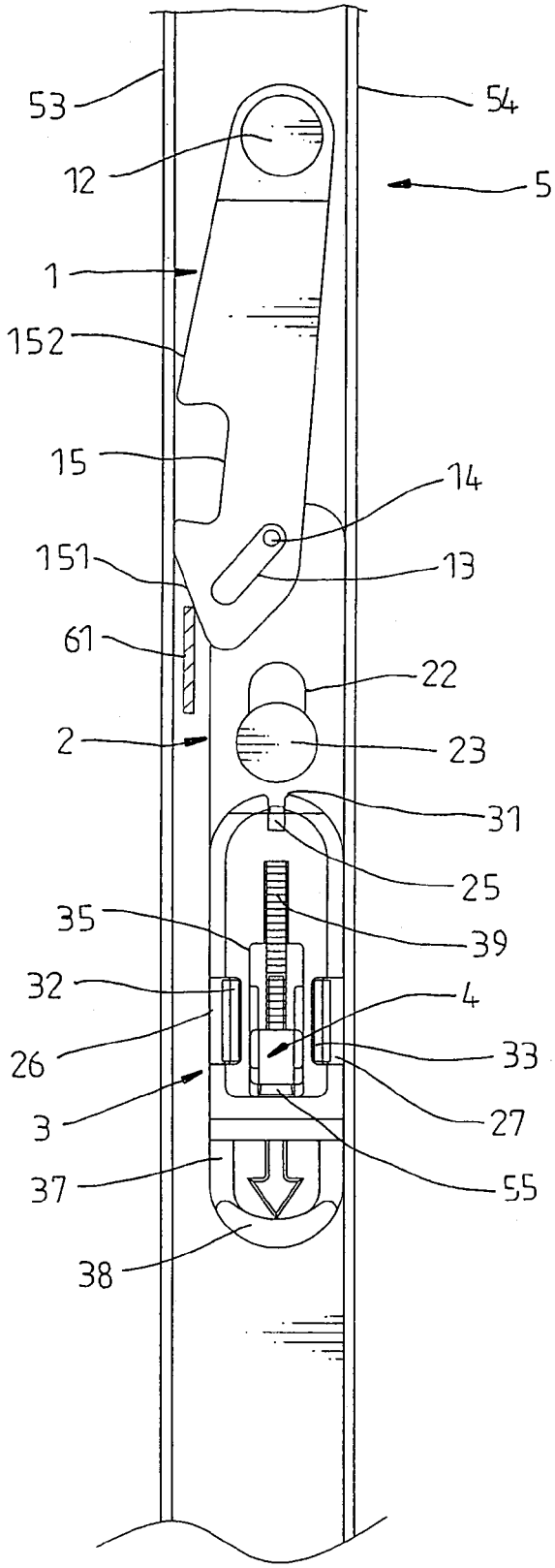
FIG. 12 is a schematic plain view of the present invention, showing the bevel guide edge of the control plate in contact with the stop block of the intermediate sliding rail.

Referring to FIGS. 6~12, an inner sliding rail mounting structure in accordance with the present invention is used in a sliding track assembly formed of an inner sliding rail 5, an intermediate sliding rail 6, and an outer sliding rail 60. The inner sliding rail 5 is longitudinally slidably mounted in the intermediate sliding rail 6. The intermediate sliding rail 6 is longitudinally slidably mounted in the outer sliding rail 60. The inner sliding rail mounting structure of the present invention can be controlled to disengage the inner sliding rail 5 from the stop block 61 of the intermediate sliding rail 6 for allowing removal of the inner sliding rail 5 from the intermediate sliding rail 6. Alternatively, the inner sliding rail mounting structure can be controlled to let the inner sliding rail 5 be inserted into the intermediate sliding rail 6 over the stop block 61. The inner sliding rail mounting structure comprises a control plate 1, a slide 2, a carriage 3, a guide block 4, and a spring member 39.

The control plate 1 has a pivot hole 11 formed on one side, namely, the front side and pivotally connected to a pivot hole 52 on the bottom wall 51 of the inner sliding rail 5 with a pivot 12, an oblique sliding slot 13 formed on the other side, namely, the rear side and cut through the top and bottom walls and coupled to the front side 21 of the slide 2 by a pivot 14, a retaining side notch 15 on one lateral side for receiving the stop block 61 of the intermediate sliding rail 6, a bevel guide edge 151 obliquely extending from the rear side of the retaining side notch 15 to the rear side of the control plate 1, and a stop edge 152 extending from the front side of the retaining side notch 15 to the front side of the control plate 1.

The slide 2 has the front side 21 pivotally connected to the oblique sliding slot 13 of the control plate 1 by the pivot 14 and kept between the control plate 1 and the inner sliding rail 5, a longitudinal sliding slot 22 cut through the top and bottom wall on the middle and extending in parallel to the extending direction of the inner sliding rail 5 and coupled to a bolt 23 that is affixed to a hole 50 on the bottom wall 51 of the inner sliding rail 5 for allowing sliding of the slide 2 along the bottom wall 51 of the inner sliding rail 5, a locating hole 24 for accommodating the carriage 3, and a plurality of protruding retaining flanges 25, 26, 27 spaced around the locating hole 24 for securing the carriage 3 to the locating hole 24 firmly in place.

The carriage 3 has a protrusion 34 fitted into the locating hole 24, a plurality of retaining notches 31, 32, 33 spaced around the border and respectively forced into engagement with the protruding retaining flanges 25, 26, 27 of the slide 2, a longitudinal sliding slot 35 extending in parallel to the extending direction of the inner sliding rail 5 for receiving the guide block 4 (see FIGS. 6 and 8), a longitudinal positioning groove 36 extending from the front side of the longitudinal sliding slot 35 toward the front side of the carriage 3, a finger strip 38 at the rear side, and a finger recess 37 formed on the bottom wall and abutted at the finger strip 38.

The guide block 4 is mounted in and movable along the longitudinal sliding slot 35 of the carriage 3 and stopped against a locating block 55 at the bottom wall 51 of the inner sliding rail 5, having a pin 41 forwardly extended from the front side.

The spring member 39 is positioned in the longitudinal positioning groove 36 of the carriage 3, having a front end 391 stopped at the front side 361 of the longitudinal positioning groove 36 and a rear end 392 sleeved onto the backwardly extending pin 41 and stopped against the front side of the guide block 4

Figure 13:
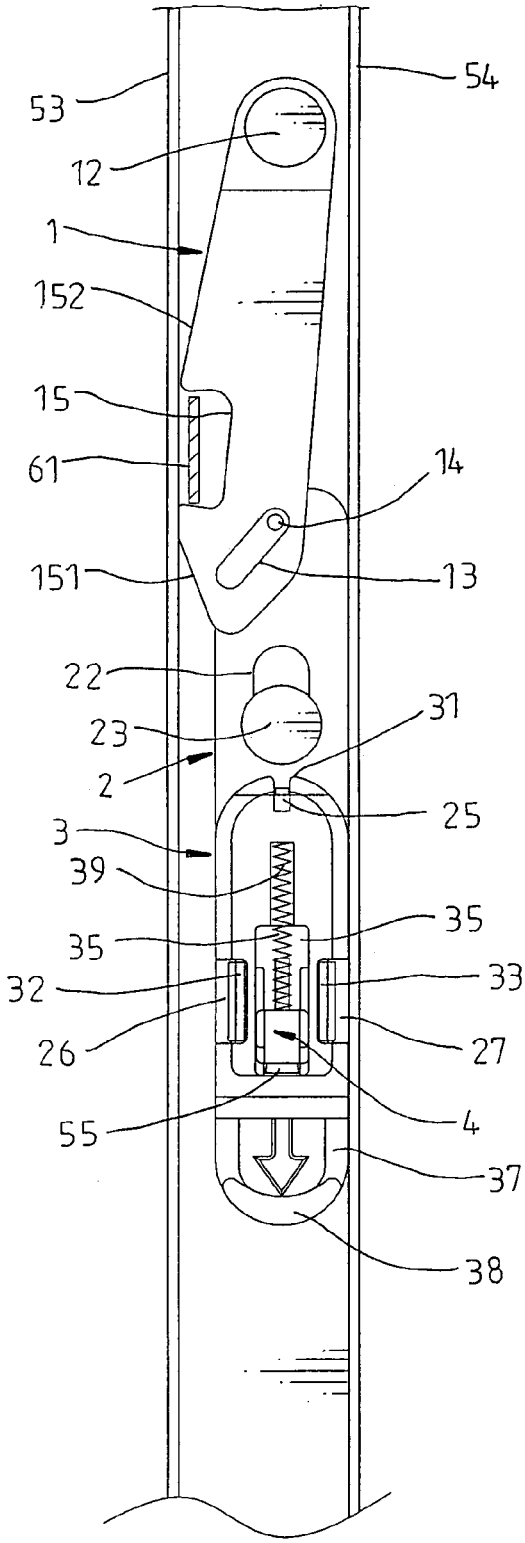
FIG. 13 is a schematic plain view of the present invention, showing the retaining side notch of the control plate engaged with the stop block of the intermediate sliding rail.

When inserting the two opposite sidewalls 53 and 54 of the inner sliding rail 5 into the intermediate sliding rail 6, pull the carriage 3 backwards to force the spring member 39 and the guide block 4 against the locating block 55 at the bottom wall 51 of the inner sliding rail 5 and to compress the spring member 39 so that the pivot 14 is moved with the slide 2 obliquely backwards along the oblique sliding slot 13 of the control plate 1 to have the front side of the longitudinal sliding slot 22 be stopped at the bolt 23. At this time, the stop edge 152 of the control plate 1 is spaced from the corresponding sidewall 53 of the inner sliding rail 5 at the maximum distance (see FIG. 10) so that the stop block 61 of the intermediate sliding rail 6 does not interfere with insertion of the inner sliding rail 5 into the inside of the intermediate sliding rail 6. When the user released the hand from the carriage 3, the spring member 39 is released to provide a forward spring force to the carriage 3 and then the slide 2, thereby returning the control plate 1 to its former position (see FIG. 11). When the user pulls the drawer (not shown) outwards from the cabinet (not shown), the inner sliding rail 5 is moved backwards (outwards) till that the bevel guide edge 151 of the control plate 1 touches the stop block 61 of the intermediate sliding rail 6 (see FIG. 12). When the inner sliding rail 5 is continuously moved backwards (outwards), the bevel guide edge 151 of the control plate 1 is forced against the stop block 61 of the intermediate sliding rail 6 to bias the control plate 1 and to further force the retaining side notch 15 into engagement with the stop block 61 of the intermediate sliding rail 6 (see FIG. 13), preventing disconnection of the inner sliding rail 5 with the drawer (not shown) from the intermediate sliding rail 6. Further, when wishing to remove the inner sliding rail 5 from the intermediate sliding rail 2, pull the inner sliding rail 5 backwards (outwards) and then pull the carriage 3 to carry the slide 2 backwards (outwards) and to further bias the control plate 1 so as to disengage the retaining side notch 15 from the stop block 61 of the intermediate sliding rail 6 (see FIG. 10) for enabling the inner sliding rail 5 to be taken away from the intermediate sliding rail 6.

As stated above, the invention provides an inner sliding rail mounting structure that has the following benefits:

1. Easy operation: Simply by pulling the carriage 3 to carry the slide 2 backwards, the control plate 1 is biased from the locking position to the unlocking position for allow insertion of the inner sliding rail 5 into the intermediate sliding rail 6 or removal of the inner sliding rail 5 from the intermediate sliding rail 6. This design is free from the consideration of the left hand or right hand operation direction.
2. Simple structural design: The inner sliding rail mounting structure uses a limited number of parts, and is easy to install with less labor and time.
3. Orthopedically engineered design: The design of the finger recess 37 and finger strip 38 of the carriage 3 allows the user to pull the carriage 3 with one single finger comfortably.

A prototype of inner sliding rail mounting structure has been constructed with the features of FIGS. 6~12. The inner sliding rail mounting structure functions smoothly to provide all of the features discussed earlier.

Although a particular embodiment of the inventions has been described in detail for purposes of illustration, various modifications and enhancements may be made without departing from the spirit and scope of the invention. Accordingly, the invention is not to be limited except as by the appended claims.

What is claimed is:

1. An inner sliding rail mounting structure installed in an inner sliding rail for allowing said inner sliding rail to be detachably mounted in an intermediate sliding rail being longitudinally slidably mounted in an outer sliding rail, the inner sliding rail mounting structure comprising:

a control plate, said control plate having a pivot hole formed on a front side thereof and pivotally connected to a pivot hole on said inner sliding rail, an oblique sliding slot formed on a rear side thereof, a retaining side notch formed on one lateral side thereof for receiving a stop block at said intermediate sliding rail to secure said inner sliding rail to said intermediate sliding rail, a bevel guide edge obliquely extending from a rear side of said retaining side notch to the rear side of said control plate for stopping against the stop block of said intermediate sliding rail to bias said control plate relative to said inner sliding rail when said inner sliding rail is pulled outwards from said intermediate sliding rail after installation of said inner sliding rail in said intermediate sliding rail, and a stop edge extending from a front side of said retaining side notch to the front side of said control plate;

a slide, said slide having a pivot fixedly disposed at a front side thereof and slidably coupled to the oblique sliding slot of said control plate, a longitudinal sliding slot formed on a middle part thereof and extending in parallel to said inner sliding rail and coupled to a fixed bolt at said inner sliding rail for allowing sliding of said slide along said inner sliding rail, a locating hole, and a plurality of protruding retaining flanges spaced around said locating hole;

a carriage, said carriage having a protrusion fitted into the locating hole of said slide, a plurality of retaining notches spaced around the border thereof and respectively forced into engagement with the protruding retaining flanges of said slide, a longitudinal sliding slot extending in parallel to the extending direction of said inner sliding rail, a longitudinal positioning groove extending from a front side of the longitudinal sliding slot of said carriage toward a front side of said carriage, a finger strip at a rear side thereof, and a finger recess abutted at said finger strip for the resting of a finger to pull said carriage;

a guide block mounted in and movable along the longitudinal sliding slot of said carriage and stopped against a locating block at said inner sliding rail, said guide block having a pin forwardly extended from a front side thereof; and a spring member positioned in the longitudinal positioning groove of said carriage, said spring member having a front end stopped at a front side said longitudinal positioning groove and a rear end sleeved onto the pin of said guide block and stopped against the front side of said guide block.

* * * * *